US010139744B2

(12) United States Patent
Hioki et al.

(10) Patent No.: US 10,139,744 B2
(45) Date of Patent: Nov. 27, 2018

(54) ELECTROSTATIC LATENT IMAGE DEVELOPING TONER

(71) Applicant: KYOCERA Document Solutions Inc., Osaka (JP)

(72) Inventors: Jun Hioki, Osaka (JP); Ryotaro Komada, Osaka (JP); Haruhiro Nishitera, Osaka (JP); Yusuke Washino, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/540,490

(22) PCT Filed: Jan. 7, 2016

(86) PCT No.: PCT/JP2016/050351

§ 371 (c)(1),
(2) Date: Jun. 28, 2017

(87) PCT Pub. No.: WO2016/121438

PCT Pub. Date: Aug. 4, 2016

(65) Prior Publication Data

US 2017/0371259 A1 Dec. 28, 2017

(30) Foreign Application Priority Data

Jan. 26, 2015 (JP) ..... 2015-012515

(51) Int. Cl.

| | |
|---|---|
| ***G03G 9/093*** | (2006.01) |
| ***G03G 9/08*** | (2006.01) |
| ***G03G 9/087*** | (2006.01) |

(52) U.S. Cl.

CPC ..... *G03G 9/09328* (2013.01); *G03G 9/0825* (2013.01); *G03G 9/08755* (2013.01); *G03G 9/09321* (2013.01); *G03G 9/09371* (2013.01); *G03G 9/09392* (2013.01)

(58) Field of Classification Search

CPC ..... G03G 9/09328; G03G 9/09321; G03G 9/09314; G03G 9/09371

See application file for complete search history.

(56) References Cited

U.S. PATENT DOCUMENTS

| | | | | |
|---|---|---|---|---|
| 5,153,093 | A * | 10/1992 | Sacripante | G03G 9/09307 430/107.1 |
| 2005/0271964 | A1 | 12/2005 | Etou et al. | |
| 2013/0011775 | A1* | 1/2013 | Itou | G03G 9/09307 430/105 |
| 2013/0273469 | A1* | 10/2013 | Akutagawa | G03G 9/08755 430/109.3 |

FOREIGN PATENT DOCUMENTS

| | | | |
|---|---|---|---|
| JP | 2004-138985 | A | 5/2004 |

OTHER PUBLICATIONS

American Chemical Society (ACS) File Registry No. RN 39394-41-7 on STN, copyright 2018, which was entered in STN on Nov. 16, 1984.*

* cited by examiner

*Primary Examiner* — Janis L Dote
(74) *Attorney, Agent, or Firm* — Studebaker & Brackett PC

(57) ABSTRACT

An electrostatic latent image developing toner includes toner particles each including a toner core (10) and a shell layer (20) covering a surface of the toner core (10). The shell layer (20) contains a hydrophilic thermosetting resin and a hydrophobic thermoplastic resin. The hydrophilic thermosetting resin is a resin having at least one functional group selected from the group consisting of oxazoline groups, carbodiimide groups, and isocyanate groups. The hydrophobic thermoplastic resin is exposed at surfaces of the toner particle.

14 Claims, 5 Drawing Sheets

ELECTROSTATIC LATENT IMAGE DEVELOPING TONER

TECHNICAL FIELD

The present invention relates to an electrostatic latent image developing toner and a production method thereof.

BACKGROUND ART

In view of energy saving and reduction in size of an image forming apparatus, there is a demand for a toner that can be favorably fixed through application of less heat to a fixing roller as far as possible. Typically, a toner excellent in low-temperature fixability is prepared using a binder resin having a low melting point or a low glass transition point or a releasing agent having a low melting point. However, in a situation in which such a toner is preserved at high temperature, toner particles included in the toner tend to agglomerate. Once the toner particles agglomerate, the agglomerating toner particle tends to reduce in charge amount when compared to other toner particles that do not agglomerate.

Furthermore, a toner including toner particles each having core-shell structure may be used for the purpose of improving low-temperature fixability, high-temperature stability, and blocking resistance of the toner. For example, Patent Literature 1 discloses a toner including toner particles each having a toner core of which surface is covered with a thin film containing a thermosetting component and of which softening point is at least 40° C. and no greater than 150° C.

CITATION LIST

Patent Literature

[Patent Literature 1] Japanese Patent Application Laid-Open Publication No. 2004-138985

SUMMARY OF INVENTION

Technical Problem

However, the toner disclosed in Patent Literature 1 uses a hydrophilic thermosetting resin such as melamine. The hydrophilic thermosetting resin tends to absorb water molecules in a high-temperature and high-humidity environment. Further, use of the thermosetting resin such as melamine tends to cause generation of free formaldehyde.

The present invention has been made in view of the foregoing problems and has its object of providing an electrostatic latent image developing toner that is excellent in high-temperature preservability, low-temperature fixability, and charge retention and in which free formaldehyde is hardly generated.

Solution to Problem

An electrostatic latent image developing toner according to the present invention includes toner particles each including a toner core and a shell layer covering a surface of the toner core. The shell layer contains a hydrophilic thermosetting resin and a hydrophobic thermoplastic resin. The hydrophilic thermosetting resin is a resin having at least one functional group selected from the group consisting of oxazoline groups, carbodiimide groups, and isocyanate groups. The hydrophobic thermoplastic resin is exposed at surfaces of the toner particles.

An electrostatic latent image developing toner producing method according to the present invention includes a toner core production process, a first shell layer formation process, and a second shell layer formation process. In the toner core production process, toner cores are produced. In the first shell layer formation process, the toner cores produced in the toner core production process, a hydrophilic thermosetting resin or a precursor thereof, and a hydrophobic thermoplastic resin or a precursor thereof are added to an aqueous medium to attach the hydrophobic thermoplastic resin or the precursor thereof to surfaces of the toner cores in the aqueous medium. In the second shell layer formation process, the aqueous medium is heated to form shell layers containing the hydrophilic thermosetting resin and the hydrophobic thermoplastic resin on the surfaces of the toner cores. In the second shell layer formation process, the hydrophilic thermosetting resin or the precursor thereof added in the first shell layer formation process becomes the hydrophilic thermosetting resin having at least one functional group selected from the group consisting of oxazoline groups, carbodiimide groups, and isocyanate groups in the aqueous medium.

Advantageous Effects of Invention

According to the present invention, a toner can be provided that is excellent in high-temperature preservability, low-temperature fixability, and charge retention and in which free formaldehyde is hardly generated.

DESCRIPTION OF EMBODIMENTS

Figure 1:
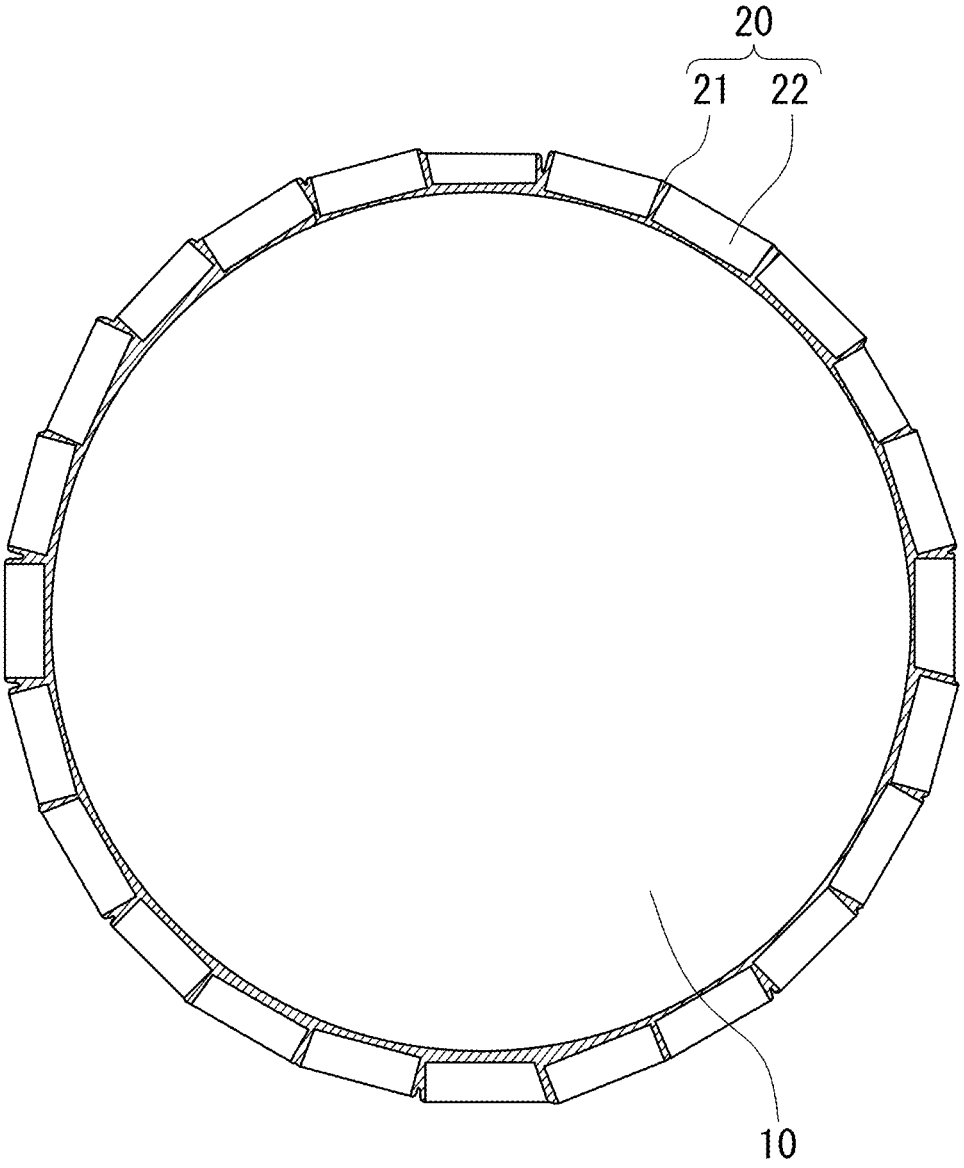
FIG. 1 is a view illustrating a toner particle included in a toner according to an embodiment of the present invention.

The following describes an embodiment of the present invention in detail. Note that evaluation results (values indicating shape, physical properties, or the like) for respective powders (specific examples include toner cores, toner mother particles, an external additive, and a toner) are number average values measured with respect to an appropriate number of average particles of the powder unless otherwise stated. A number average particle diameter of a powder is a number average value of equivalent circular diameters of primary particles (diameters of circles having the same areas as projected areas of the respective particles) measured using a microscope unless otherwise stated.

Note that in the present description the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Furthermore, the term "(meth)acryl" is used as a generic term for both acryl and methacryl.

A toner according to the present embodiment is an electrostatic latent image developing toner. The toner according to the present embodiment includes a large number of toner particles. The toner according to the present embodiment can be used in for example an electrophotographic apparatus (image forming apparatus).

An example of a method for forming an image using an electrophotographic apparatus will be described below. An electrostatic latent image is first formed on a photosensitive member based on image data. The formed electrostatic latent image is then developed with a two-component developer containing a carrier and a toner. In the developing process, the toner charged by friction with the carrier is attached to the electrostatic latent image to form a toner image on the photosensitive member. In a subsequent transfer process, the toner image on the photosensitive member is transferred to a transfer belt and the toner image on the transfer belt is further transferred to a recording medium (for example, paper). The toner is then heated to be fixed to the recording medium. Through the above processes, an image is formed on the recording medium. Superposition of toner images in four colors of for example black, yellow, magenta, and cyan can result in formation of a full-color image.

The toner according to the present embodiment has the following features (1)-(3).

(1) The toner particles each include a toner core and a shell layer covering a surface of the toner core. The shell layer contains a hydrophilic thermosetting resin and a hydrophobic thermoplastic resin.
(2) The hydrophilic thermosetting resin is a resin having at least one functional group selected from the group consisting of oxazoline groups, carbodiimide groups, and isocyanate groups.
(3) The hydrophobic thermoplastic resin is exposed at surfaces of the toner particles.

Feature (1) is advantageous for improving both high-temperature preservability and low-temperature fixability of the toner. Specifically, high-temperature preservability of the toner is considered to be improved by covering the toner cores with the shell layers. Further, it is considered that high-temperature preservability of the toner is improved through use of the hydrophilic thermosetting resin and low-temperature fixability is improved through use of the hydrophobic thermoplastic resin.

Feature (2) is advantageous for inhibiting generation of free formaldehyde. Specifically, the resin having at least one functional group selected from the group consisting of oxazoline groups, carbodiimide groups, and isocyanate groups as defined in feature (2) can be synthesized without using formaldehyde as a raw material. Therefore, it is considered that use of the resin defined in feature (2) can inhibit generation of free formaldehyde more than use of an amino resin (for example, a melamine resin). Note that the amount of free formaldehyde can be measured for example in accordance with Japanese Industrial Standard (JIS K5601-4-1(2012)). The amount of free formaldehyde measured in accordance with Japanese Industrial Standard (JIS K5601-4-1(2012)) is preferably no greater than 5 ppm, more preferably no greater than 1 ppm, and most preferably 0 ppm (or non-detectable).

Feature (3) is advantageous for reducing charge decay of the toner. Specifically, exposure of the hydrophobic thermoplastic resin at the surfaces of the toner particles causes the surfaces of the toner particles to hardly adsorb moisture even in a high-temperature and high-humidity environment. As a result, charge retention of the toner is improved and charge decay of the toner is reduced.

The toner according to the present embodiment includes the toner particles having all of features (1)-(3) (also referred to below as toner particles of the present embodiment). The toner including the toner particles of the present embodiment is excellent in high-temperature preservability, low-temperature fixability, and charge retention. Further, free formaldehyde is hardly generated in the toner (see Table 1, which will be mentioned later). Note that the toner includes the toner particles of the present embodiment preferably at a rate of at least 80% by number, more preferably at least 90% by number, and further preferably 100% by number.

The electrostatic latent image developing toner preferably has the following feature (4) in addition to features (1)-(3) in order to improve both low-temperature fixability and high-temperature preservability of the toner.

(4) In the shell layer, a plurality of blocks substantially formed from the hydrophobic thermoplastic resin are connected to one another through a junction portion substantially formed from the hydrophilic thermosetting resin. An additive may be dispersed in the hydrophobic thermoplastic resin forming the blocks. Also, an additive may be dispersed in the hydrophilic thermosetting resin forming the junction portion. Note that the amount of the hydrophobic thermoplastic resin contained in the blocks is preferably at least 80% by mass relative to a total mass of all the blocks, more preferably 90% by mass, and most preferably 100% by mass. Furthermore, the amount of the hydrophilic thermosetting resin contained in the junction portion is preferably at least 80% by mass relative to a mass of the entire junction portion, more preferably 90% by mass, and most preferably 100% by mass.

The following describes the toner having features (1)-(4) with reference to FIGS. 1-4.

FIG. 1 illustrates a toner particle included in the toner according to the present embodiment. The toner particle includes a toner core 10 and a shell layer 20 covering the toner core 10. The shell layer 20 includes a junction portion 21 and a plurality of blocks 22. The junction portion 21 is formed substantially from a hydrophilic thermosetting resin. The blocks 22 is each formed substantially from a hydrophobic thermoplastic resin. In the shell layer 20, micro blocks 22 are formed in respective regions defined by the junction portion 21. For example, all the blocks 22 are each exposed at the surface of the toner particle. However, the above should not be taken as a limitation and a part of the blocks 22 may not be exposed at the surface of the toner particle.

Figure 2:
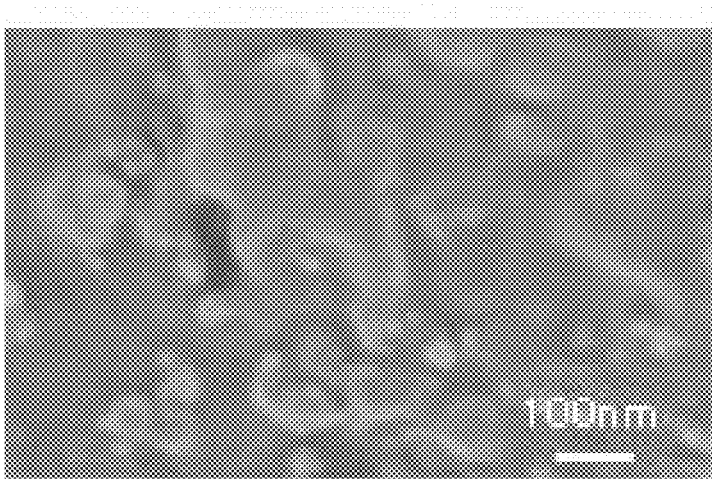
FIG. 2 is a SEM photograph showing structure of a shell layer in the toner according to the embodiment of the present invention.
Figure 3:
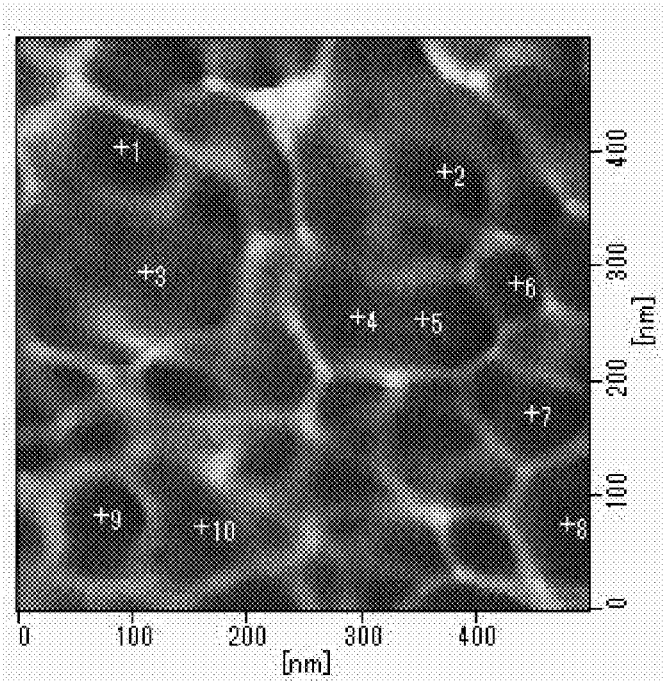
FIG. 3 is a SPM photograph showing the structure of the shell layer in the toner according to the embodiment of the present invention.

FIG. 2 is a SEM photograph showing structure of the shell layer defined in feature (4). FIG. 3 is a SPM photograph showing the structure of the shell layer defined in feature (4). As shown in FIGS. 2 and 3, the surface (shell layer 20) of the toner particle has sea-island structure. The blocks 22 and the junction portion 21 form the sea-island structure as shown in FIGS. 2 and 3.

Figure 4:
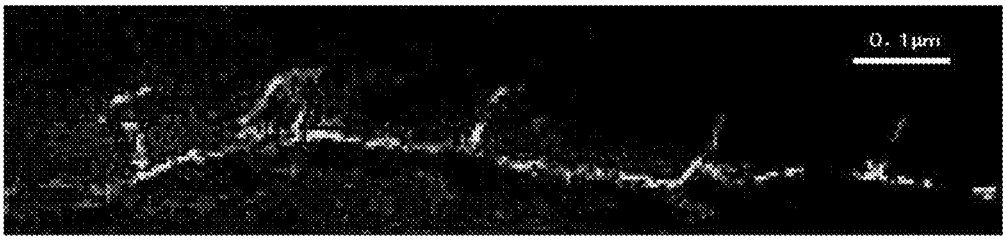
FIG. 4 is a TEM photograph taken of a section of a toner particle in the toner according to the embodiment of the present invention.

FIG. 4 is a TEM photograph taken of a section of a toner particle. Specifically, FIG. 4 is a TEM photograph of the section of the toner particle having features (1)-(4) that is taken by electron energy loss spectroscopy (EELS) using a transmission electron microscope (TEM). As shown in FIG. 4, protrusions formed from the hydrophilic thermosetting resin containing many nitrogen atoms are formed in places on the surface of the toner particle. The hydrophobic thermoplastic resin distributes so as to fill gaps between the protrusions. As described above, the hydrophobic thermoplastic resin is exposed at the surface of the toner particle in an example shown in FIG. 4.

Figure 5:
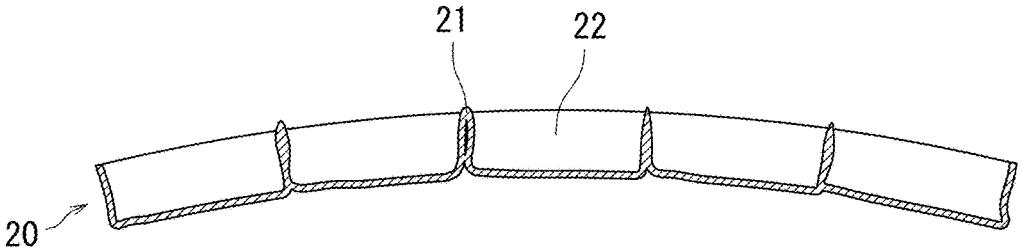
FIG. 5 is an enlarged view illustrating the structure of the shell layer in the toner according to the embodiment of the present invention.

FIG. 5 is an enlarged view of the shell layer 20 illustrated in FIG. 1. The structure of the shell layer 20 will be described further in detail below with reference mainly to FIGS. 1 and 5.

As illustrated in FIGS. 1 and 5, the junction portion 21 is disposed between a block 22 and another block 22. The blocks 22 are each partitioned by the junction portion 21 (walls of the junction portion 21) disposed between the block 22 and the other block 22. Furthermore, the junction portion 21 is also disposed in a gap between the blocks 22 and the toner core 10. Part of the junction portion 21 (a film of the junction portion 21) located in the gap between the blocks 22 and the toner core 10 is connected to the respective walls of the junction portion 21 to be integrated as the entirety of the junction portion 21. However, no limitation is placed on the above and the junction portion 21 may be partially parted.

The hydrophobic thermoplastic resin is softened when heated at a temperature of at least its glass transition point (Tg). However, the hydrophobic thermoplastic resin (blocks 22) are partitioned by the hydrophilic thermosetting resin (junction portion 21) in the shell layer of the toner having features (1)-(4). In the above configuration, the toner particles hardly deform even when the temperature of the shell layer reaches Tg of the hydrophobic thermoplastic resin. In such the toner, deformation of the toner particles can be initiated only by concurrent application of heat and pressure to the toner particles. Further in such the toner, agglomeration of the toner particles can be inhibited in a situation in which no power is applied to the toner. In the above configuration, the toner having features (1)-(4) is excellent in both high-temperature preservability and low-temperature fixability.

The toner particles each include a toner core and a shell layer covering the surface of the toner core. The toner core contains a binder resin. The toner particle may contain an optional component (for example, at least one of a colorant, a releasing agent, a charge control agent, and a magnetic powder) in the binder resin as needed.

An external additive may be added to surfaces of toner mother particles as needed. Toner particles prior to treatment with an external additive may be also referred to below as toner mother particles. Furthermore, a plurality of shell layers may be layered on the surface of the toner core.

The toner may be used as a one-component developer. Alternatively, the toner may be mixed with a carrier to prepare a two-component developer.

[Toner Core]

(Binder Resin)

The binder resin usually occupies almost all part of components (for example, 85% by mass) in the toner core. In the above configuration, properties of the binder resin are thought to have a large influence on overall properties of the toner cores. For example, in a configuration in which the binder resin has an ester group, a hydroxyl group, an ether group, an acid group, or a methyl group, the toner cores have a stronger tendency to be anionic. By contrast, in a configuration in which the binder resin has an amino group or an amide group, the toner cores have a stronger tendency to be cationic. In order that the binder resin is strongly anionic, the binder resin preferably has a hydroxyl value (measured in accordance with Japan Industrial Standard (JIS) K0070-1992) and an acid value (measured in accordance with Japan Industrial Standard (JIS) K0070-1992) that each are at least 10 mg KOH/g, and more preferably at least 20 mg KOH/g.

The binder resin preferably has at least one functional group selected from the group consisting of ester groups, hydroxyl groups, ether groups, acid groups, and methyl groups, with either or both of a hydroxyl group and a carboxyl group being more preferable. A binder resin having a functional group such as listed above readily reacts with shell materials (for example, carbodiimide) to form chemical bonds. Formation of chemical bonds between the binder resin and the shell materials ensures strong bonding between the toner cores and the shell layers. Also, the binder resin preferably has a functional group including activated hydrogen in molecules thereof.

The binder resin preferably has a glass transition point (Tg) that is no greater than a curing initiation temperature of the shell materials. It is thought that as a result of using a binder resin having Tg such as described above, the toner tends to have sufficient fixability even when subjected to high speed fixing.

Tg of the binder resin can be measured for example using a differential scanning calorimeter. More specifically, Tg of the binder resin can be obtained from a point of change of specific heat on a heat absorption curve that is plotted by measuring a sample (the binder resin) using a differential scanning calorimeter.

The binder resin preferably has a softening point (Tm) of no greater than 100° C., and more preferably no greater than 95° C. In a configuration in which Tm of the binder resin is no greater than 100° C., the toner tends to have sufficient fixability even when subjected to high speed fixing. Further, in a configuration in which Tm of the binder resin is no greater than 100° C., partial softening of the toner cores tends to occur during curing reaction of the shell layers in formation of the shell layers on the surfaces of the toner cores in an aqueous medium. As a result, the toner cores tend to become round in shape due to surface tension. Note that use of a combination of a plurality of resins having different softening points (Tm) can adjust Tm of the binder resin.

Tm of the binder resin can be measured for example using a capillary rheometer. More specifically, melt flow of a sample (the binder resin) set in the capillary rheometer is caused under specific conditions. An S-shaped curve is then plotted for the binder resin. Tm of the binder resin can be read from the plotted S-shaped curve. Tm of the measurement sample (binder resin) is a temperature on the plotted S-shaped curve corresponding to a stroke value of $(S_1+S_2)/2$, where $S_1$ represents a maximum stroke value and $S_2$ represents a base line stroke value at low temperatures.

The binder resin is preferably a thermoplastic resin. Suitable examples of a thermoplastic resin that can be used as the binder resin include styrene-based resins, acrylic acid-based resins, olefin-based resins (specific examples include a polyethylene resin and a polypropylene resin), vinyl resins (specific examples include a vinyl chloride resin, a polyvinyl alcohol, a vinyl ether resin, and an N-vinyl resin), polyester resins, polyamide resins, urethane resins, styrene-acrylic acid-based resins, and styrene-butadiene-based resins. Among the resins listed above, a styrene-acrylic acid-based resin or a polyester resin is preferable in terms of improving dispersibility of a colorant in the toner cores, chargeability of the toner, and fixability of the toner to a recording medium.

A styrene-acrylic acid-based resin that can be used as the binder resin will be described below. Note that the styrene-acrylic acid-based resin is a copolymer of at least one styrene-based monomer and at least one acrylic acid-based monomer.

Suitable examples of the styrene-based monomer include styrene, α-methylstyrene, p-hydroxy styrene, m-hydroxy styrene, vinyltoluene, α-chlorostyrene, o-chlorostyrene, m-chlorostyrene, p-chlorostyrene, and p-ethylstyrene.

Suitable examples of the acrylic acid-based monomer include (meth)acrylic acid, (meth)acrylic acid alkyl ester, and (meth)acrylic acid hydroxyalkyl ester. Examples of (meth)acrylic acid alkyl ester include methyl (meth)acrylate, ethyl (meth)acrylate, n-propyl (meth)acrylate, iso-propyl (meth)acrylate, n-butyl (meth)acrylate, iso-butyl (meth) acrylate, and 2-ethylhexyl (meth)acrylate. Examples of (meth)acrylic acid hydroxyalkyl ester include 2-hydroxyethyl (meth)acrylate, 3-hydroxypropyl (meth)acrylate, 2-hydroxy propyl (meth)acrylate, and 4-hydroxybutyl (meth) acrylate.

In a situation in which a styrene-acrylic acid-based resin is prepared, use of a monomer having a hydroxyl group (examples include p-hydroxy styrene, m-hydroxystyrene, and (meth)acrylic acid hydroxyalkyl ester) can result in introduction of the hydroxyl group into the styrene-acrylic acid-based resin. Further, adjustment of the amount of the monomer having the hydroxyl group can result in adjustment of the hydroxyl value of a yielded styrene-acrylic acid-based resin.

Use of an acrylic acid-based monomer having a carboxyl group in preparation of a styrene-acrylic acid-based resin can result in introduction of the carboxyl group into the styrene-acrylic acid-based resin. Furthermore, adjustment of the amount of (meth)acrylic acid can result in adjustment of the acid value of a yielded styrene-acrylic acid-based resin.

In a configuration in which the binder resin contains a styrene-acrylic acid-based resin, the styrene-acrylic acid-based resin preferably has a number average molecular weight (Mn) of at least 2,000 and no greater than 3,000 in order to improve both strength of the toner cores and fixability of the toner. The styrene-acrylic acid-based resin preferably has a molecular weight distribution (ratio Mw/Mn of mass average molecular weight (Mw) relative to number average molecular weight (Mn)) of at least 10 and no greater than 20. Measurement of Mn and Mw of a styrene-acrylic acid-based resin can be performed by gel permeation chromatography.

A polyester resin that can be used as the binder resin will be described below. Note that the polyester resin can be prepared through condensation polymerization of a di-, tri-, or higher-hydric alcohol with a di-, tri-, or higher-basic carboxylic acid.

Examples of a dihydric alcohol that can be used to prepare the polyester resin include diols and bisphenols.

Suitable examples of diols include ethylene glycol, diethylene glycol, triethylene glycol, 1,2-propanediolm, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Suitable examples of bisphenols include bisphenol A, hydrogenated bisphenol A, bisphenol A ethylene oxide adducts, and bisphenol A propylene oxide adducts.

Suitable examples of a tri- or higher-hydric alcohol that can be used to prepare the polyester resin include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Suitable examples of a dibasic carboxylic acid that can be used to prepare the polyester resin include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid. succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Suitable examples of a tri- or higher-basic carboxylic acid that can be used to prepare the polyester resin include 1,2,4-benzene tricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

One of the alcohols or the carboxylic acids listed above may be used or two or more of the alcohols or the carboxylic acids listed above may be used in combination. Furthermore, any of the di-, tri- or higher-basic carboxylic acid listed above may be derivatized into an ester-forming derivative such as an acid halide, an acid anhydride, or a lower alkyl ester for use. The term "lower alkyl" herein refers to an alkyl group having 1 to 6 carbon atoms.

The acid value and the hydroxyl value of the polyester resin can be adjusted by changing the respective amounts of an alcohol and a carboxylic acid are changed in preparation of the polyester resin. When the polyester resin is increased in molecular weight, the acid value and the hydroxyl value of the polyester resin tend to reduce.

In a configuration in which the binder resin contains the polyester resin, the polyester resin preferably has a number average molecular weight (Mn) of at least 1,000 and no greater than 2,000 in order to improve both strength of the toner cores and fixability of the toner. The polyester resin preferably has a molecular weight distribution (ratio Mw/Mn of mass average molecular weight (Mw) relative to number average molecular weight (Mn)) of at least 9 and no greater than 21. Mn and Mw of the polyester resin can be measured by gel permeation chromatography.

(Colorant)

The toner cores may optionally contain a colorant. The colorant can be a commonly known pigment or dye that match the color of the toner. The amount of the colorant is preferably at least 1 part by mass and no greater than 20 parts by mass relative to 100 parts by mass of the binder resin, and more preferably at least 3 parts by mass and no greater than 10 parts by mass.

The toner cores may optionally contain a black colorant. An example of the black colorant is carbon black. In another example, the black colorant may be a colorant that is adjusted to a black color using a yellow colorant, a magenta colorant, and a cyan colorant.

The toner cores may optionally contain a non-black colorant such as a yellow colorant, a magenta colorant, or a cyan colorant.

Examples of the yellow colorant include condensed azo compounds, isoindolinone compounds, anthraquinone compounds, azo metal complexes, methine compounds, and arylamide compounds. Suitable examples of the yellow colorant include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), naphthol yellow S, Hansa Yellow G, and C.I. Vat Yellow.

Examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Suitable examples of the magenta colorant include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of the cyan colorant include copper phthalocyanine compounds, anthraquinone compounds, and basic dye lake compounds. Suitable examples of the cyan colorant include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The toner core may optionally contain a releasing agent. The releasing agent is used for example for the purpose of improving fixability or offset resistance of the toner. In order to increase anionic strength of the toner cores, the toner cores are preferably prepared using an anionic wax. The amount of the releasing agent is preferably at least 1 part by mass and no greater than 30 parts by mass relative to 100 parts by mass of the binder resin in order to improve fixability or offset resistance of the toner, and more preferably at least 5 parts by mass and no greater than 20 parts by mass.

Suitable examples of the releasing agent include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as oxidized polyethylene wax and block copolymer of oxidized polyethylene wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes containing partially or fully deoxidized fatty acid esters such as deoxidized carnauba wax.

Note that a compatibilizer may optionally be added to the toner cores in order to improve compatibility between the binder resin and the releasing agent.

(Charge Control Agent)

The toner cores may optionally contain a charge control agent. The charge control agent is used for example for the purpose of improving charge stability or a charge rise characteristics of the toner. Anionic strength of the toner cores can be increased by including a negatively chargeable charge control agent in the toner cores. The charge rise characteristic of the toner is an indicator as to whether or not the toner can be charged to a specific charge level in a short period of time.

(Magnetic Powder)

The toner cores may optionally contain a magnetic powder. Examples of a material of the magnetic powder include ferromagnetic metals (specific examples include iron, cobalt, and nickel) or alloys thereof, ferromagnetic metal oxides (specific examples include ferrite, magnetite, and chromium dioxide), and materials subjected to ferromagnetization (more specifically, thermal treatment or the like). One type of magnetic powders listed above may be used or plural types of magnetic powders listed above may be used in combination.

The magnetic powder is preferably subjected to surface treatment in order to inhibit elution of metal ions (for example, iron ions) from the magnetic powder. In a situation in which the shell layers are formed on the surfaces of the toner cores under acidic conditions, elution of metal ions to the surfaces of the toner cores causes the toner cores to have a greater tendency to adhere to one another. Adhesion of the toner cores to one another can be inhibited by inhibiting elution of metal ions from the magnetic powder.

[Shell Layer]

The shell layer contains the hydrophilic thermosetting resin and the hydrophobic thermoplastic resin. In the above configuration, the shell layer formed on the surface of the toner core tends to have uniform thickness. Furthermore, when the hydrophobic thermoplastic resin is contained in the shell layers in addition to the hydrophilic thermosetting resin, the charge amount of the toner can be easily adjusted within a desired range. In order to obtain a toner excellent in high-temperature preservability, low-temperature fixability, and charge retention, the amount of the hydrophilic thermosetting resin is preferably at least 0.1 parts by mass and no greater than 5 parts by mass relative to 100 parts by mass of the toner cores and the amount of the hydrophobic thermoplastic resin is preferably at least 30 parts by mass and no greater than 150 parts by mass relative to 100 parts by mass of the toner cores. Note that the shell layer may contain a charge control agent (for example, a positively chargeable charge control agent).

The hydrophobic thermoplastic resin preferably has a functional group (for example, a hydroxyl group, a carboxyl group, an amino group, a carbodiimide group, an oxazoline group, or a glycidyl group) that can readily react with a functional group of the hydrophilic thermosetting resin (for example, an oxazoline group, a carbodiimide group, or an isocyanate group). The hydrophobic thermoplastic resin may have an amino group in the form of a carbamoyl group ($—CONH_2$).

The hydrophobic thermoplastic resin preferably includes a repeating unit derived from an acrylic acid-based monomer in order to improve film quality of the shell layers. The hydrophobic thermoplastic resin preferably includes a repeating unit having an alcoholic hydroxyl group in order to improve film quality of the shell layers, and particularly preferably includes a repeating unit derived from 2-hydroxyethyl methacrylate (2-HEMA). Meanwhile, in order to sufficiently inhibit adsorption of moisture in the air to the surfaces of the shell layers, a ratio of the repeating unit having a hydrophilic functional group is preferably no greater than 10% by mass relative to all repeating units that the resin forming the shell layers has. Examples of the hydrophilic functional group include acid groups (specific examples include carboxyl group and a sulfo group), hydroxyl groups, and salts of any of the aforementioned groups (specific examples include —COONa, —$SO_3Na$, and —ONa). Examples of a monomer that can be used to include a repeating unit having an alcoholic hydroxyl group in the shell layers include 2-hydroxyalkyl ester (meth) acrylates (particularly preferable examples include 2-hydroxyethyl acrylate (BHEA), 2-hydroxy propyl acrylate (HPA), 2-hydroxyethyl methacrylate (HEMA), and 2-hydroxy propyl methacrylate).

Specific examples of the hydrophobic thermoplastic resin include acrylic acid-based resins, styrene-acrylic acid-based copolymer, silicone-acrylic acid-based graft copolymer, urethane resins, polyester resins, and ethylene-vinyl alcohol copolymer. An acrylic acid-based resin, a styrene-acrylic acid-based copolymer, or a silicone-acrylic acid-based graft copolymer is preferable as the hydrophobic thermoplastic resin, and an acrylic acid-based resin is more preferable.

Examples of an acrylic acid-based monomer that can be used to include the hydrophobic thermoplastic resin in the shell layers include: (meth)acrylic acid alkyl ester such as methyl (meth)acrylate, ethyl (meth)acrylate, n-propyl (meth)acrylate, and n-butyl (meth)acrylate; (meth)acrylic acid aryl ester such as phenyl (meth)acrylate; (meth)acrylic acid hydroxyalkyl ester such as 2-hydroxyethyl (meth)acrylate, 3-hydroxypropyl (meth)acrylate, 2-hydroxy propyl (meth)acrylate, and 4-hydroxybutyl (meth)acrylate; (meth) acrylamide; ethylene oxide adducts of (meth)acrylic acids; alkyl ethers of ethylene oxide adducts of (meth)acrylic acid ester (for example, methyl ether, ethyl ether, n-propyl ether, and n-butyl ether).

The hydrophilic thermosetting resin is a resin having at least one group selected from the group consisting of oxazoline groups, carbodiimide groups, and isocyanate groups (also referred to below as a specific functional group-containing resin). At least one selected from the group consisting of polyoxazoline resins, polycarbodiimide resins, polyisocyanate resins, and derivatives of any of the aforementioned resins is preferable as the specific functional group-containing resin. A polymer of a monomer containing at least one compound selected from the group consisting of 2-isopropenyl-2-oxazoline, 2-(penta-4-ynyl)-2-oxazoline, 2-isocyanatoethyl acrylate, 2-isocyanatoethyl methacrylate, 1-aryl urea, and derivatives of any of the aforementioned monomers is further preferable. An oxazoline group, a carbodiimide group, and an isocyanate group each tend to form cross-linking structure (eventually, three-dimensional net structure) in a resin. For example, the oxazoline group tends to react with a carboxyl group to form amide ester bonds. In another example, the carbodiimide group tends to react with a carboxyl group to form N-acyl urea bonds. Further, the isocyanate group tends to react with a hydroxyl group to form urethane bonds. Note that a cross-link hardening function of the hydrophilic thermosetting resin can be improved by including a nitrogen element in the hydrophilic thermosetting resin.

The shell layer may have fractures (portions having low mechanical strength). The fractures can be formed by causing localized defects to occur in the shell layers. Formation of the fractures enables the shell layer to be readily fractured. As a result, the toner can be fixed to a recording medium at low temperatures. Any number of fractures may be provided.

[External Additive]

An external additive may be attached to the surfaces of the toner particles as needed. Examples of the external additive include fine particles of metal oxides (specific examples include alumina, titanium oxide, magnesium oxide, zinc oxide, strontium titanate, and barium titanate) and fine particles of silica.

The external additive preferably has a particle diameter of at least 0.01 μm and no greater than 1.0 μm. The amount of the external additive is preferably at least 0.5 parts by mass and no greater than 10 parts by mass relative to 100 parts by mass of the toner mother particles, and more preferably at least 1 part by mass and no greater than 5 parts by mass.

[Carrier]

A two-component developer can be prepared by mixing the toner of the present embodiment with a carrier. A magnetic carrier is preferably used for preparation of the two-component developer.

A suitable example of the carrier is a powder of carrier particles each having a carrier core covered with a resin. Specific examples of the carrier cores include: particles of iron, oxidized iron, reduced iron, magnetite, copper, silicon steel, ferrite, nickel, or cobalt; particles of alloy of any of the above-mentioned materials and a metal such as manganese, zinc, or aluminum; particles of iron-nickel alloy or iron-cobalt alloy; particles of a ceramic (specific examples include titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate); and particles of high-dielectric substances (examples include ammonium dihydrogen phosphate, potassium dihydrogen phosphate, and Rochelle salt). In a configuration in which the carrier cores are formed from a resin, any type of the particles listed above (for example, ferrite particles) may be dispersed in the resin forming the carrier cores.

Examples of the resin covering the carrier cores include acrylic acid-based polymers, styrene-based polymers, styrene-acrylic acid-based copolymers, olefin-based polymers (specific examples include polyethylene, chlorinated polyethylene, and polypropylene), polyvinyl chloride, polyvinyl acetate, polycarbonate, cellulose resins, polyester resins, unsaturated polyester resins, polyamide resins, urethane resins, epoxy resins, silicone resins, fluororesins (specific examples include polytetrafluoroethylene, polychlorotrifluoroethylene, and polyvinylidene fluoride), phenolic resins, xylene resins, diallyl phthalate resins, polyacetal resins, and amino resins. Two or more of the resins listed above may be used in combination.

The carrier preferably has a particle diameter measured using an electron microscope of at least 20 μm and no greater than 120 μm, and more preferably at least 25 μm and no greater than 80 μm.

In a situation in which the two-component developer is prepared using the toner and the carrier, the content of the toner is preferably at least 3% by mass and no greater than 20% by mass relative to the mass of the two-component developer, and preferably at least 5% by mass and no greater than 15% by mass.

[Toner Production Method]

The following describes a production method of the electrostatic latent image developing toner according to the present embodiment. The production method of the electrostatic latent image developing toner according to the present embodiment includes a toner core production process, a first shell layer formation process, and a second shell layer formation process. Toner cores are produced in the toner core production process. In the first shell layer formation process, the toner cores produced in the toner core production process, a hydrophilic thermosetting resin or a precursor thereof, and a hydrophobic thermoplastic resin or a precursor thereof are added to an aqueous medium to attach the hydrophobic thermoplastic resin or the precursor thereof to surfaces of the toner cores in the aqueous medium. In the second shell layer formation process, the aqueous medium containing shell materials (the hydrophilic thermosetting resin or the precursor thereof and the hydrophobic thermoplastic resin or the precursor thereof) is heated to form shell layers containing the hydrophilic thermosetting resin and the hydrophobic thermoplastic resin on the surfaces of the toner cores. In the second shell layer formation process, the hydrophilic thermosetting resin or the precursor thereof added in the first shell layer formation process becomes a hydrophilic thermosetting resin having at least one functional group selected from the group consisting of oxazoline groups, carbodiimide groups, and isocyanate groups in the aqueous medium.

(Toner Core Production Process)

A pulverization method or an aggregation method is preferably employed as a toner core production process.

In the pulverization method, a binder resin and internal additives (for example, a colorant, a releasing agent, a charge control agent, and a magnetic powder) are mixed together. Subsequently, the resultant mixture is melt and kneaded. Subsequently, the kneaded substance is pulverized. The pulverized product is then classified. As a result, toner cores each having a desired particle diameter are produced. The toner cores can be comparatively easily produced according to the pulverization method.

The aggregation method involves for example an aggregation process and a coalescence process. In the aggregating process, plural types of fine particles each containing a toner core component (for example, a binder resin fine particles, colorant fine particles, or releasing agent fine particles) are aggregated in an aqueous medium to form aggregated particles. In the coalescence process, the components contained in the aggregated particles are caused to coalesce in the aqueous medium to form toner cores. The toner cores having uniform shape and equal in particle diameter can be easily formed according to the aggregation method.

(Shell Layer Formation Process)

In the shell layer formation process, shell layers are formed on surfaces of the toner cores. The shell layers are formed for example with a hydrophilic thermosetting resin precursor (for example, a monomer or prepolymer of a hydrophilic thermosetting resin) and a hydrophobic thermoplastic resin. Specifically, the toner cores produced in the toner core production process, the hydrophilic thermosetting resin precursor, and the hydrophobic thermoplastic resin are added to an aqueous medium. A compound having at least one functional group selected from the group consisting of oxazoline groups, carbodiimide groups, and isocyanate groups is preferable as the hydrophilic thermosetting resin precursor. Note that a hydrophobic thermoplastic resin precursor (for example, a prepolymer of a hydrophobic thermoplastic resin) may be added to the aqueous medium in place of the hydrophobic thermoplastic resin. Further, a hydrophilic thermosetting resin may be added to the aqueous medium in place of the hydrophilic thermosetting resin precursor. The hydrophobic thermoplastic resin is insoluble and the hydrophilic thermosetting resin is soluble in an aqueous medium in a normal temperature (about 25° C.) atmosphere.

Shell layer formation is preferably performed in the aqueous medium in order to prevent dissolution of the binder resin or elution of the releasing agent. The aqueous medium is a medium of which main component is water (specific examples include pure water and a mixed liquid of water and a polar medium). The aqueous medium may function as a solvent. A solute may be dissolved in the aqueous medium. The aqueous medium may function as a dispersion medium. A dispersoid may be dispersed in the aqueous medium. An alcohol (specifically, methanol or ethanol) can be used for example as a polar medium in the aqueous medium. The aqueous medium has a boiling point of approximately 100° C.

Figure 6:
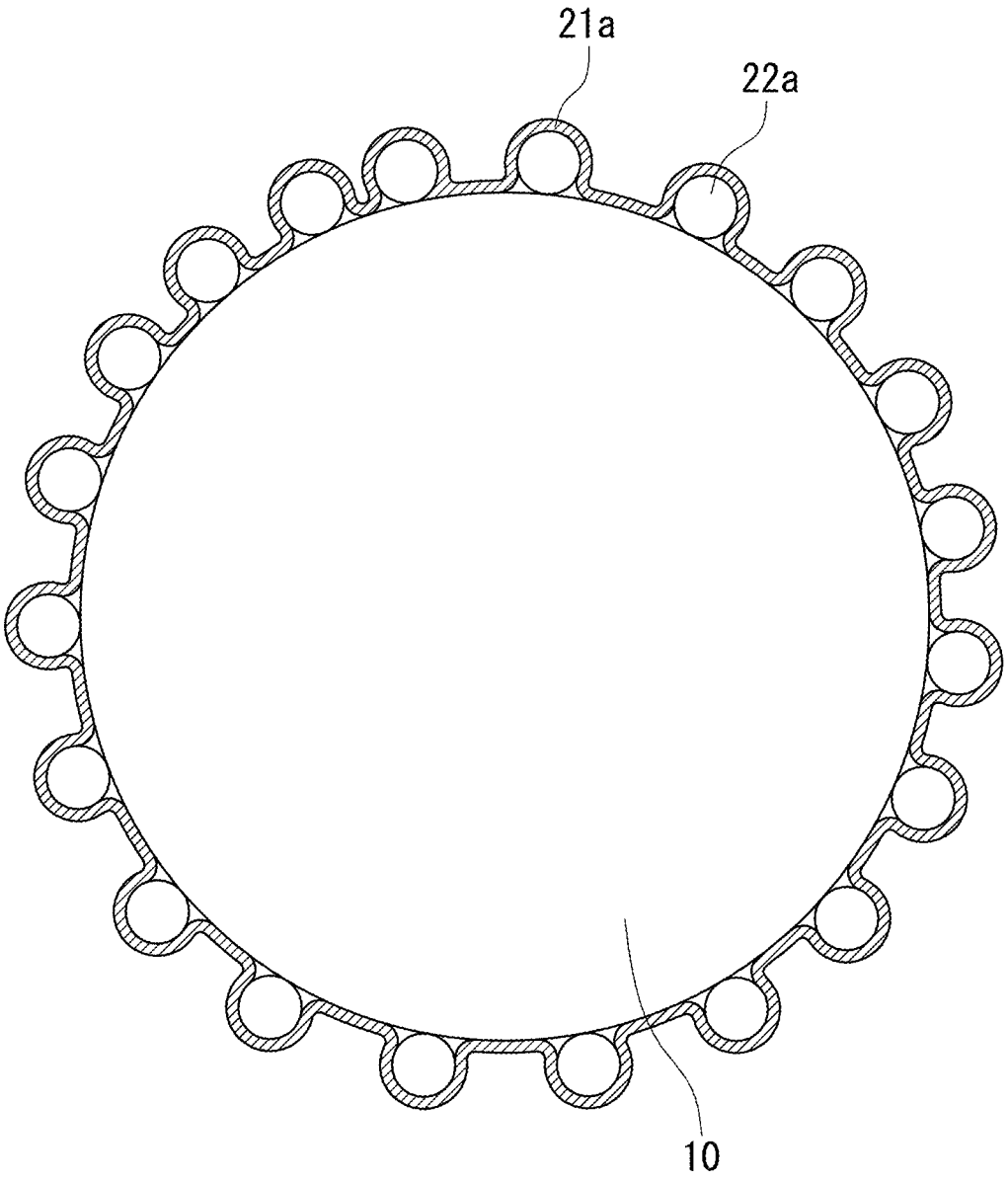
FIG. 6 is a diagram explaining a shell layer formation process in a toner production method according to the embodiment of the present invention.
Figure 7:
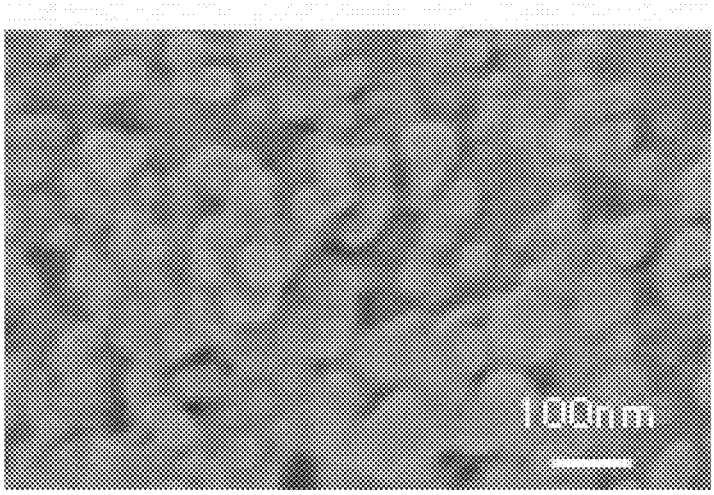
FIG. 7 is a SEM photograph of a surface of a toner core to which a hydrophilic thermosetting resin precursor and a hydrophobic thermoplastic resin are attached in the process illustrated in FIG. 6, which is taken using a scanning electron microscope.
Figure 8:
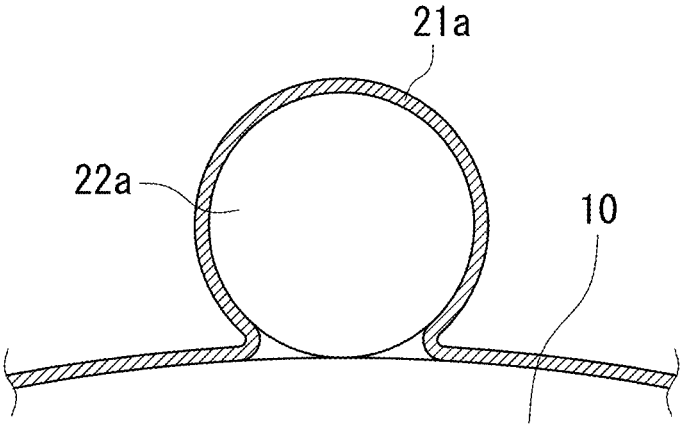
FIG. 8 is an enlarged view illustrating a part of the surface of the toner core to which the hydrophilic thermosetting resin precursor and the hydrophobic thermoplastic resin are attached in the process illustrated in FIG. 6.

The following describes the shell layer formation process with reference mainly to FIGS. 6-8. FIGS. 6-8 each show a state in which the hydrophobic thermoplastic resin is attached to a surface of a toner core in the toner production method according to the present embodiment. FIG. 7 is a SEM photograph. FIG. 8 is an enlarged partial view of FIG. 6.

When the toner cores and the shell materials (the hydrophilic thermosetting resin precursor and the hydrophobic thermoplastic resin) are added to the aqueous medium, the hydrophobic thermoplastic resin in particle shape are adsorbed to the surfaces of the toner cores in the aqueous medium. Further, the hydrophilic thermosetting resin precursor is formed so as to cover the surfaces of the toner cores to which the particle-shaped hydrophobic thermoplastic resin is attached. Specifically, as illustrated in FIG. 6, a film 21*a* of the hydrophilic thermosetting resin precursor and particles 22*a* of the hydrophobic thermoplastic resin are disposed on the surfaces of the toner cores. The film 21*a* and the particles 22*a* are each attached to the surfaced of the toner cores.

It is considered that the hydrophobic thermoplastic resin, which is hydrophobic, aggregates but does not spread in the aqueous medium to form the particles 22*a*. The plural particles 22*a* on the surface of the toner core covered with the film 21*a* can be observed in the SEM photograph of FIG. 7. It is considered that the particles 22*a* are each surrounded by the toner core 10 and the film 21*a* not to be exposed to the aqueous medium (almost out of contact with the aqueous medium).

Subsequently, the aqueous medium (specifically, a dispersion of the toner cores on each of which the film 21*a* and the particles 22*a* are disposed) is increased up to a specific temperature while being stirred, and is kept at the specific temperature. Through the above, the shell materials (the hydrophilic thermosetting resin precursor and the hydrophobic thermoplastic resin) attached to the surfaces of the toner cores react to be hardened. As a result, shell layers are formed on the surfaces of the toner cores, thereby yielding a dispersion of toner mother particles.

The shell materials (the hydrophobic thermoplastic resin and the hydrophilic thermosetting resin precursor) are attached to the toner cores prior to hardening of the shell layers. As such, it is considered that the particles of the hydrophobic thermoplastic resin are not fused together on the surfaces of the respective toner cores even when the shell layers are hardened by heating. Further, the hydrophilic thermosetting resin precursor prior to heating, which has strong hydrophilicity, is considered to be present at boundaries between the aqueous medium and the particles of the hydrophobic thermoplastic resin. However, the hydrophilicity of the hydrophilic thermosetting resin precursor tends to reduce as the curing reaction of the shell layers progresses. For the reason as above, the hydrophilic thermosetting resin precursor is considered to move between blocks of the hydrophobic thermoplastic resin through capillarity and eventually between blocks of the hydrophobic thermoplastic resin and the toner cores during the hardening reaction of the shell layers.

An example of a method for favorably dispersing the toner cores in the aqueous medium is mechanical dispersion of the toner cores in the aqueous medium for example using an apparatus capable of strongly stirring a dispersion.

The pH of the aqueous medium is preferably adjusted to approximately 4 using an acid substance prior to addition of the materials for forming the shell layers. The aqueous medium is adjusted to an acidic pH to accelerate a reaction for forming the shell layers.

Formation of the shell layers on the surfaces of the toner cores is preferably performed at a temperature of at least 40° C. and no greater than 95° C. in order to favorably promote shell layer formation, and more preferably at least 50° C. and no greater than 80° C.

After the shell layers are formed as described above, the toner mother particle-containing dispersion is cooled to normal temperature. Thereafter, a toner is produced through a process of washing the toner mother particles (washing process), a process of drying the toner mother particles (drying process), and a process of attaching an external additive to the surfaces of the toner mother particles (external addition process) as needed.

In the washing process, the toner mother particles are washed with water. Suitable examples of a washing method includes: a method in which a wet cake of the toner mother particle is collected from the toner mother particle-containing dispersion by solid-liquid separation and washed with water; and a method in which a supernatant obtained by causing the toner mother particles in the dispersion to precipitate is substituted by water and the toner mother particles after substitution are re-dispersed in water.

In the drying process, the toner mother particles are dried. A suitable example of a method for drying the toner mother particles is a method using a dryer (specifically, a spray dryer, a fluidized bed dryer, a vacuum freeze dryer, or a reduced pressure dryer). Use of a spray dryer is preferable in order to inhibit agglomeration of the toner mother particles during drying. In the method using the spray dryer, an external additive such as silica can be attached to the surfaces of the toner mother particles by spraying a dispersion of the external additive toward the toner mother particles.

In the external addition process, an external additive is attached to the surfaces of the toner mother particles. A suitable example of a method for attaching the external additive is mixing of the toner mother particles with the external additive using a mixer (specifically, an FM mixer or a Nauta mixer (registered Japanese trademark)) under a condition that the external additive is not buried in the surfaces of the toner mother particles.

Note that the toner production method described above may be altered as appropriate in accordance with requirements of the toner, such as in terms of composition and properties. For example, the toner cores may be added to a solvent after the materials of the shell layers are dissolved in the solvent. Alternatively, the materials of the shell layers may be dissolved in a solvent after the toner cores are added to the solvent. Any shell layer formation process can be employed. The shell layers may for example be formed through any of an in-situ polymerization process, an in-liquid curing film coating process, and a coacervation process. Furthermore, non-essential processes may be omitted. In a situation in which no external additive is attached to the surfaces of the toner mother particles (i.e., the external addition process is omitted), the toner mother particles and the toner particles are equivalent. In order to efficiently produce the toner, preferably a large number of toner particles are formed at the same time.

EXAMPLES

The following describes Examples. Table 1 lists toners of Examples 1-9 and Comparative Examples 1-4 (each are an electrostatic latent image developing toner).

TABLE 1

| | Thermoplastic resin | | | Hydrophilic thermosetting resin | |
|---|---|---|---|---|---|
| | Type | Property | Amount [mL] | Type | Amount [g] |
| Example 1 | I | Hydrophobic | 15 | Oxazoline group containing polymer | 3.15 |
| Example 2 | II | | 15 | Oxazoline group containing polymer | 3.15 |
| Example 3 | III | | 15 | Oxazoline group containing polymer | 3.15 |
| Example 4 | I | Hydrophobic | 15 | Carbodiimide group containing polymer | 2.00 |
| Example 5 | I | | 15 | Isocyanate group containing polymer | 4.00 |
| Example 6 | I | | 15 | Oxazoline group containing polymer | 5.00 |
| Example 7 | I | | 15 | Oxazoline group containing polymer | 2.00 |
| Example 8 | I | Hydrophobic | 30 | Oxazoline group containing polymer | 3.15 |
| Example 9 | I | | 10 | Oxazoline group containing polymer | 3.15 |
| Comparative Example 1 | I | Hydrophobic | 15 | Methylol melamine solution | 0.35 |
| Comparative Example 2 | IV | Hydrophilic | 27 | Oxazoline group containing polymer | 3.15 |
| Comparative Example 3 | I | Hydrophobic | 15 | — | — |
| Comparative Example 4 | — | — | — | Oxazoline group containing polymer | 3.15 |

(Preparation of Thermoplastic Resin Fine Particles I)

A 1-L three-necked flask equipped with a thermometer and a stirring impeller was charged with 875 mL of ion exchanged water and 75 mL of an anionic surfactant ("LATEMUL WX" manufactured by Kao Corporation, sodium polyoxyethylene alkyl ether sulfate). Then, the internal temperature of the flask was increased to 80° C. using a water bath. Then, a mixed liquid of 17 mL of styrene and 3 mL of butyl acrylate, and a solution in which 0.5 g of potassium peroxodisulfate is dissolved in 30 mL of ion exchanged water were separately dripped into the flak over five hours each. The flask contents were kept at 80° C. for two hours to cause polymerization of a polymerizable monomer added to the flask. As a result, a suspension of hydrophobic thermoplastic resin fine particles I (solid concentration: 2% by mass) was obtained. The resultant thermoplastic resin fine particles I were observed using a transmission electron microscope to confirm that the fine particles had a number average particle diameter of 32 nm. Tg of the thermoplastic resin fine particles I measured using a differential scanning calorimeter was 71° C.

(Preparation of Thermoplastic Resin Fine Particles II)

A suspension of hydrophobic thermoplastic resin fine particles II (solid concentration: 2% by mass) was prepared according to the same method as for the thermoplastic resin fine particles I in all aspects other than that the additive amount of the anionic surfactant was changed from 75 mL to 25 mL. The resultant thermoplastic resin fine particles II were observed using the transmission electron microscope to confirm that the fine particles had an number average particle diameter of 107 nm. Tg of the thermoplastic resin fine particles II measured using the differential scanning calorimeter was 68° C.

(Preparation of Thermoplastic Resin Fine Particles III)

A suspension of hydrophobic thermoplastic resin fine particles III (solid concentration: 10% by mass) was prepared according to the same method as for the thermoplastic resin fine particles I in all aspects other than that butyl acrylate was not added and the additive amount of styrene was changed from 17 mL to 100 mL. The resultant thermoplastic resin fine particles III were observed using the transmission electron microscope to confirm that the fine particles had an number average particle diameter of 30 nm. Tg of the thermoplastic resin fine particles III measured using the differential scanning calorimeter was 103° C.

Example 1

(Toner Core Preparation)

An FM mixer (manufactured by Nippon Coke & Engineering Co., Ltd.) was used to mix 750 g of a low-viscosity polyester resin (Tg: 38° C., Tm: 65° C.), 100 g of an intermediate-viscosity polyester resin (Tg: 53° C., Tm: 84° C.), 150 g of a high-viscosity polyester resin (Tg: 71° C., Tm: 120° C.), 55 g of a releasing agent (carnauba wax: "Carnauba Wax Type 1" manufactured by S. Kato & Co.), and 40 g of a colorant (Phthalocyanine Blue: "KET BLUE 111" manufactured by DIC Corporation) at a rotational speed of 2,400 rpm. The resultant mixture was melt and knead using a two-axis extruder ("PCM-30" manufactured by Ikegai Corp.) under conditions of a material loading rate of 5 kg/hour, a shaft rotational speed of 160 rpm, and a temperature setting range of from 100° C. to 130° C. The resultant kneaded product was cooled and then coarsely pulverized using a pulverizer ("Rotoplex (registered Japanese trademark)" manufactured by Hosokawa Micron Corporation). The resultant coarsely pulverized product was then finely pulverized using a jet mill ("Ultrasonic Jet Mil Type I" manufactured by Nippon Pneumatic Mfg. Co., Ltd.). Subsequently, the resultant finely pulverized product was classified using a classifier ("Elbow Jet Type EJ-LABO" manufactured by Nittetsu Mining Co., Ltd.). As a result, toner cores were prepared.

(Shell Layer Formation)

After 300 mL of ion exchanged water was added to a 1-L three-necked flask equipped with a thermometer and a stirring impeller, the internal temperature of the flask was kept at 30° C. using a water bath. Subsequently, dilute hydrochloric acid was added to the flask to adjust the pH of the aqueous medium in the flask to 4. After the pH adjustment, 3.15 g of an oxazoline group-containing polymer solution ("EPOCROS (registered Japanese trademark) WS-300" manufactured by NIPPON SHOKUBAI CO., LTD., solid concentration: 25% by mass) and 15 mL of the suspension of the thermoplastic resin fine particles I were added to the flask as raw materials of the shell layers. The raw materials of the shell layers (especially, an oxazoline group-containing polymer) were dissolved in the aqueous medium, thereby yielding an aqueous solution of the raw materials of the shell layers. Then, 300 g of the toner cores were added to the yielded aqueous solution and the flask contents were stirred at a rotational speed of 200 rpm for one hour. Next, 300 mL of ion exchanged water was added to the flask. Thereafter, the internal temperature of the flask was increased up to 70° C. at a rate of 1° C./min. while the flask contents were stirred at a rotational speed of 100 rpm. After the temperature increase, stirring of the flask contents was continued for two hours under conditions of a temperature of 70° C. and a rotational speed of 100 rpm. Thereafter, sodium hydroxide was added to the flask to adjust the pH of the flask contents to 7. The flask contents were then cooled to normal temperature (approximately 25° C.), thereby yielding a toner mother particle-containing dispersion.

(Washing Process)

A wet cake of toner mother particles was collected from the toner mother particle-containing dispersion using a Buchner funnel. Subsequently, the wet cake of the toner mother particles was re-dispersed in ion exchanged water to wash the toner mother particles. Washing of the toner mother particles using ion exchanged water as above were preformed five times.

(Drying Process)

The wet cake of the toner mother particles obtained in the washing process was dispersed in an ethanol solution having a concentration of 50% by mass to prepare a slurry. The resultant slurry was supplied to a continuous surface-modifying apparatus ("Coatmizer (registered Japanese trademark)" manufactured by Freund Corporation) to dry the toner mother particles in the slurry, thereby obtaining toner mother particles. The drying process was performed under conditions of a hot air temperature of 45° C. and a flow rate of 2 $m^3$/min.

(External Addition Process)

A 10-L FM mixer (a product of Nippon Coke & Engineering Co., Ltd.) was used to mix 100 parts by mass of the toner mother particles obtained in the drying process and 1.0 part by mass of dry silica ("AEROSIL (registered Japanese trademark) REA90" manufactured by Nippon Aerosil Co., Ltd.) for five minutes to attach an external additive to the surfaces of the toner mother particles. The resultant toner was then sifted using a 200 mesh sieve (opening: 75 μm), thereby producing a toner of Example 1.

Example 2

A toner of Example 2 was produced according to the same method as for the toner of Example 1 in all aspects other than that 15 mL of the suspension of the thermoplastic resin fine particles II was added in place of 15 mL of the suspension of the thermoplastic resin fine particles I in the shell layer forming step.

Example 3

A toner of Example 3 was produced according to the same method as for the toner of Example 1 in all aspects other than that 15 mL of the suspension of the thermoplastic resin fine particles III was added in place of 15 mL of the suspension of the thermoplastic resin fine particles I in the shell layer forming step.

Example 4

A toner of Example 4 was produced according to the same method as for the toner of Example 1 in all aspects other than that 2.00 g of a carbodiimide group-containing polymer solution ("CARBODILITE (registered Japanese trademark) V-02" manufactured by Nisshinbo Chemical Inc., solid concentration: 40% by mass) was added as a raw material of the shell layers in place of 3.15 g of the oxazoline group-containing polymer solution in the shell layer formation process.

Example 5

A toner of Example 5 was produced according to the same method as for the toner of Example 1 in all aspects other than that 4.00 g of an isocyanate group-containing polymer solution ("ELASTRON (registered Japanese trademark) H-38" manufactured by DKS Co. Ltd., solid concentration: 20% by mass) was added as a raw material of the shell layers in place of 3.15 g of the oxazoline group-containing polymer solution in the shell layer formation process.

Example 6

A toner of Example 6 was produced according to the same method as for the toner of Example 1 in all aspects other than that the additive amount of the oxazoline group-containing polymer solution was changed from 3.15 g to 5.00 g in the shell layer formation process.

Example 7

A toner of Example 7 was produced according to the same method as for the toner of Example 1 in all aspects other than that the additive amount of the oxazoline group-containing polymer solution was changed from 3.15 g to 2.00 g in the shell layer formation process.

Example 8

A toner of Example 8 was produced according to the same method as for the toner of Example 1 in all aspects other than that the additive amount of the suspension of the thermoplastic resin fine particles I was changed from 15 mL to 30 mL in the shell layer formation process.

Example 9

A toner of Example 9 was produced according to the same method as for the toner of Example 1 in all aspects other than that the additive amount of the suspension of the thermoplastic resin fine particles I was changed from 15 mL to 10 mL in the shell layer formation process.

Comparative Example 1

A toner of Comparative Example 1 was produced according to the same method as for the toner of Example 1 in all aspects other than that 0.35 g of a methylol melamine solution ("MIRBANE (registered Japanese trademark) RESIN SM-607" manufactured by Showa Denko K.K., solid concentration: 80% by mass) was added as a raw material of the shell layers in place of 3.15 g of the oxazoline group-containing polymer solution in the shell layer formation process.

Comparative Example 2

A toner of Comparative Example 2 was produced according to the same method as for the toner of Example 1 in all aspects other than that 27 mL of a suspension of hydrophilic thermoplastic resin fine particles IV ("BECKAMINE (registered Japanese trademark) A-1" manufactured by DIC Corporation, component: water-soluble polyacrylamide, solid concentration: 11% by mass) was added in place of the suspension of the thermoplastic resin fine particles I in the shell layer formation process.

Comparative Example 3

A toner of Comparative Example 3 was produced according to the same method as for the toner of Comparative Example 1 in all aspects other than that the methylol melamine solution was not added in the shell layer formation process.

Comparative Example 4

A toner of Comparative Example 4 was produced according to the same method as for the toner of Example 1 in all aspects other than that the suspension of the thermoplastic resin fine particles I was not added in the shell layer formation process.

[Evaluation Method]

Evaluation methods for each of each of samples (the toners of Examples 1-9 and Comparative Examples 1-4) are as follows.

<High-temperature Preservability>

A 20-mL polyethylene vessel was charged with 2 g of the sample (toner). Then, the vessel was left in a thermostatic oven set at 60° C. for three hours. The vessel was taken out from the thermostatic oven and cooled, thereby obtaining an evaluation toner in the vessel. Subsequently, the evaluation toner was placed on a 100-mesh sieve (opening: 150 μm) having a known mass. The mass of the sieve including the evaluation toner was measured to obtain a mass of the toner before sifting. Next, the sieve was placed in a powder tester (a product of Hosokawa Micron Corporation) and caused to vibrate in accordance with a manual of the powder tester at a rheostat level of 5 for 30 seconds in order to sift the evaluation toner. After the sifting, the mass of the toner that had not passed through the sieve (remained on the sieve) was measured. The degree of aggregation (unit: % by mass) of the sample was calculated according to the following expression from the mass of the sample before being sifted and the mass of the sample after being sifted (mass of the toner not passed through the sieve).

Degree of aggregation (% by mass)=100×(mass of toner after being sifted)/(mass of toner before being sifted)

High-temperature preservability of the sample (toner) was evaluated based on the calculated degree of aggregation in accordance with the following criteria.

(Very good): Degree of aggregation was less than 30% by mass.

(Good): Degree of aggregation was at least 30% by mass and no greater than 50% by mass.

(No good): Degree of aggregation was greater than 50% by mass.

<Charge Retention (Charge Decay Constant)>

The charge decay constant α of a toner in an external additive-free state (charge decay constant of toner particles) was measured by a method in accordance with Japanese Industrial Standard (JIS C 61340-2-1) using an electrostatic dissipation measuring device ("NS-D100" manufactured by Nano Seeds Corporation). The method for measuring the charge decay constant of a toner will be described below in detail.

A sample (toner in an external additive-free state) was loaded in a measurement cell. The measurement cell was a metal cell having a recess with an inner diameter of 10 mm and a depth of 1 mm. The sample was filled in the recess of the cell by being thrust from above using slide glass. Any of the sample that overflowed from the cell was removed by moving the slide glass back and forth on the surface of the cell. At least 0.04 g and no greater than 0.06 g of the sample was loaded into the cell.

Subsequently, the measurement cell filled with the sample was left for 12 hours in an environment at a temperature of 32° C. and a relative humidity of 80% RH. The measurement cell was then grounded and placed in the electrostatic dissipation measuring device. Ions were then supplied to the sample through corona discharge to charge the sample for 0.5 seconds. The surface potential of the sample was measured continuously starting from 0.7 seconds after completion of the corona discharge. The charge decay constant (charge decay rate) a was calculated based on the measured surface potential and an equation "$V=V0\exp(-\alpha\sqrt{t})$". In the equation, V represents a surface potential [V], $V_0$ represents an initial surface potential [V], and t represents a decay time [sec]. The calculated charge decay constant α was evaluated in accordance with the following criteria.

(Very good): Charge decay constant α was less than 0.015.

(Good): Charge decay constant α was at least 0.015 and less than 0.020.

(Poor): Charge decay constant α was at least 0.020.

<Preparation of Two-component Developer>

A two-component developer prepared according to the following method was used to evaluate low-temperature fixability, drum adhesion, and transfer efficiency of each of the samples (toners).

A developer carrier (carrier for "TASKa1fa5550ci" manufactured by KYOCERA Document Solutions Inc.) and 10% by mass of the toner relative to the mass of the developer carrier were mixed for 30 minutes using a ball mill, thereby preparing an evaluation developer (two-component developer).

<Low-temperature Fixability>

A color printer ("FS-05250DN" manufactured by KYOCERA Document Solutions Inc.) including a roller-roller type heat and pressure fixing device (nip width: 8 mm) was modified so as to be capable of changing the fixing temperature for use as an evaluation apparatus. The evaluation developer (two-component developer) prepared as described above was charged in a developing device of the evaluation apparatus, and a sample (toner for replenishment) was loaded in a toner container of the evaluation apparatus.

For fixability evaluation on the sample (toner), a solid image having a size of 25 mm by 25 mm and a printing rate of 100% was formed on paper having a size of 90 g/m$^2$ (A4-size printing paper) using the above evaluation apparatus under conditions of a linear velocity of 200 mm/sec (a transit time of the paper through a nip of the fixing section was 40 ms) and a toner applied amount of 1.0 mg/cm$^2$. Subsequently, the paper having the image formed thereon was passed through the fixing device. The fixing temperature was set in a range from 100° C. to 200° C. Specifically, a lowest temperature at which the toner (solid image) could be fixed to the paper (lowest fixing temperature) was measured through gradual increase of the fixing temperature of the fixing device from 100° C.

In the minimum fixing temperature measurement, fixing of the toner was confirmed by a folding and rubbing test such as described below. Specifically, the paper was folded in half such that a surface on which the image was formed was folded inward, and a 1-kg weight covered with cloth was rubbed back and forth on the fold ten times. The paper was then unfolded to observe the folded portion of the paper (portion on which the solid image was formed). The length of toner peeling (peeling length) in the folded portion was measured. The minimum fixing temperature was determined to be the lowest temperature among fixing temperatures for which the peeling length was no greater than 1 mm. Low-temperature fixability of the sample (toner) was evaluated based on the determined lowest fixing temperature in accordance with the following criteria.

(Very good): Lowest fixing temperature was less than 150° C.

(Good): Lowest fixing temperature was at least 150° C. and less than 160° C.

(Poor): Lowest fixing temperature was at least 160° C.

<Transfer Efficiency and Resistance to Drum Adhesion>

A color multifunction peripheral ("TASKa1fa5550ci" manufactured by KYOCERA Document Solutions Inc.) was used as an evaluation apparatus in transfer efficiency evaluation. The evaluation developer (two-component developer) prepared through the process described above was charged in a developing device of the evaluation apparatus, and a sample (toner for replenishment) was loaded in a toner container of the evaluation apparatus. Continuous printing of an image having a printing rate of 5% was performed on 10,000 recording medium sheets (A4-size printing paper) in an environment of a temperature of 32° C. and a humidity of 80% RH while replenishment of the sample (toner) was performed). During the continuous printing, whether or not coloration with the toner on the surface of a photosensitive drum was caused was confirmed through periodical visual observation. Further, the respective masses of consumed toner and collected toner were measured after the continuous printing to calculate transfer efficiency (unit: %) using the following equation.

$$\text{Transfer efficiency}=100\times(\text{mass of consumed toner}-\text{mass of collected toner})/(\text{mass of consumed toner})$$

Note that the consumed toner is toner of the sample (toner) loaded in the toner container that was ejected from the toner container. By contrast, the collected toner is toner of the consumed toner that was not transferred to a recording medium.

Transfer efficiency of the sample (toner) was evaluated in accordance with the following criteria.

(Very good): Transfer efficiency was at least 90%.

(Good): Transfer efficiency was at least 85% and less than 90%.

(Poor): Transfer efficiency was less than 85%.

Resistance to drum adhesion of the sample (toner) was evaluated in accordance with the following criteria.

(Good): No coloration with toner was observed on the surface of the photosensitive drum and no dash mark was observed in a solid image.

(Poor): Coloration with toner was observed on the surface of the photosensitive drum and a dash mark was observed in a solid image.

A situation determined as good as above was determined as "no drum adhesion". Note that the dash mark is an image defect caused due to adhesion of toner to the surface of the photosensitive drum.

<Amount of Free Formaldehyde>

In accordance with Japanese Industrial Standard (JIS K5601-4-1(2012)), the amount of formaldehyde in a measurement target (toner) was detected by high performance liquid chromatography (HPLC) using a high-performance liquid chromatography ("LC-2010A HT" manufactured by Shimadzu Corporation) and a DNPH derivative. Measurement conditions of an oven temperature of a column of 40° C. and a measurement wavelength of 360 nm were used. The amount of free formaldehyde (unit: ppm) was calculated using the following equation from the mass (unit: g) of the measurement target (toner) and the mass (unit: g) of detected formaldehyde.

$$\text{Amount of free formaldehyde}=10^6\times(\text{mass of detected formaldehyde})/(\text{mass of toner})$$

The mass of free formaldehyde was evaluated in accordance with the following criteria.

(Good): The mass of free formaldehyde was less than 5 ppm.

(Poor): The mass of free formaldehyde was at least 5 ppm.

[Evaluation Results]

Evaluation results for the toner of Examples 1-9 and Comparative Examples 1-4 are indicated in Table 2. Table 2 indicates respective evaluation results of high-temperature preservability (degree of aggregation), low-temperature fixability (lowest fixing temperature), charge retention (charge decay constant), resistance to drum adhesion (presence or absence of drum adhesion), transfer efficiency, and the amount of free formaldehyde (fee $CH_2O$). The term "n.d." as to the amount of free formaldehyde (free $CH_2O$) in Table 2 indicates that free formaldehyde was not detected (the amount of free formaldehyde was no greater than 1 ppm).

TABLE 2

| | High-temperature preservability [% by mass] | Low-temperature fixability [° C.] | Charge decay | Drum adhesion | Transfer efficiency [%] | Free $CH_2O$ [ppm] |
|---|---|---|---|---|---|---|
| Example 1 | 25 | 149 | 0.012 | Absent | 90 | n.d. |
| Example 2 | 47 | 145 | 0.013 | Absent | 88 | n.d. |
| Example 3 | 20 | 152 | 0.010 | Absent | 95 | n.d. |
| Example 4 | 28 | 148 | 0.012 | Absent | 89 | n.d. |
| Example 5 | 22 | 151 | 0.011 | Absent | 93 | n.d. |
| Example 6 | 18 | 157 | 0.015 | Absent | 86 | n.d. |
| Example 7 | 42 | 147 | 0.010 | Absent | 88 | n.d. |
| Example 8 | 15 | 158 | 0.010 | Absent | 91 | n.d. |
| Example 9 | 37 | 146 | 0.011 | Absent | 90 | n.d. |
| Comparative Example 1 | 20 | 149 | 0.011 | Absent | 92 | 10 (Poor) |
| Comparative Example 2 | 80 (No good) | 140 | 0.052 (Poor) | Absent | 62 (Poor) | n.d. |
| Comparative Example 3 | 65 (No good) | 143 | 0.011 | Present (500 pieces) | 87 | n.d. |
| Comparative Example 4 | 77 (No good) | 142 | 0.010 | Absent | 83 (Poor) | n.d. |

The toners of Examples 1-9 each were an electrostatic latent image developing toner having the aforementioned features (1)-(3). Specifically, the toners of Examples 1-9 each included toner particles each including a toner core and a shell layer covering the surface of the toner core. The shell layer contained a hydrophilic thermosetting resin and a hydrophobic thermoplastic resin. The hydrophilic thermosetting resin was a resin having at least one functional group selected from the group consisting of oxazoline groups, carbodiimide groups, and isocyanate groups. Further, the hydrophobic thermoplastic resin was exposed at the surfaces of the toner particles (specifically, the toners each had the aforementioned feature (4)).

As indicated in Table 2, the toners of Examples 1-9 each were excellent in low-temperature fixability, charge retention, resistance to drum adhesion, and transfer efficiency. Furthermore, free formaldehyde was not detected in each of the toners of Examples 1-9. By contrast, methylol melamine was used as a hydrophilic thermosetting resin precursor in the toner of Comparative Example 1, with a result that free formaldehyde was generated.

INDUSTRIAL APPLICABILITY

The electrostatic latent image developing toner according to the present invention can be used for forming an image for example in a multifunction peripheral, a copier, or a printer.

The invention claimed is:

1. An electrostatic latent image developing toner comprising toner particles each including a toner core and a shell layer covering a surface of the toner core, wherein the shell layer contains a hydrophilic thermosetting resin and a hydrophobic thermoplastic resin, the hydrophilic thermosetting resin is a resin having at least one functional group selected from the group consisting of oxazoline groups, carbodiimide groups, and isocyanate groups, the hydrophobic thermoplastic resin is exposed at surfaces of the toner particles, and in the shell layer, a plurality of blocks formed substantially from the hydrophobic thermoplastic resin are connected to one another through a junction portion formed substantially from the hydrophilic thermosetting resin.

2. The electrostatic latent image developing toner according to claim 1, wherein the hydrophilic thermosetting resin is at least a resin selected from the group consisting of polyoxazoline resins, polycarbodiimide resins, and polyisocyanate resins.

3. The electrostatic latent image developing toner according to claim 1, wherein an amount of the hydrophilic thermosetting resin is at least 0.1 parts by mass and no greater than 5 parts by mass relative to 100 parts by mass of the toner cores, and an amount of the hydrophobic thermoplastic resin is at least 30 parts by mass and no greater than 150 parts by mass relative 100 parts by mass of the toner cores.

4. The electrostatic latent image developing toner according to claim 1, wherein the toner core contains a polyester resin.

5. The electrostatic latent image developing toner according to claim 1, wherein the toner core contains a polyester resin, the hydrophilic thermosetting resin is a carbodiimide group-containing polymer, and the hydrophobic thermoplastic resin is a styrene-acrylic acid-based copolymer.

6. The electrostatic latent image developing toner according to claim 1, wherein the toner core contains a polyester resin, the hydrophilic thermosetting resin is a isocyanate group-containing polymer, and the hydrophobic thermoplastic resin is a styrene-acrylic acid-based copolymer.

7. The electrostatic latent image developing toner according to claim 1, wherein the toner core contains a polyester resin, the hydrophilic thermosetting resin is an oxazoline group-containing polymer, and the hydrophobic thermoplastic resin is a styrene-acrylic acid-based copolymer.

8. An electrostatic latent image developing toner comprising toner particles each including a toner core and a shell layer covering a surface of the toner core, wherein the shell layer contains a hydrophilic thermosetting resin and a hydrophobic thermoplastic resin, the hydrophilic thermosetting resin is a resin having at least one functional group selected from the group consisting of oxazoline groups, carbodiimide groups, and isocyanate groups, the hydrophobic thermoplastic resin is exposed at surfaces of the toner particles, and the hydrophilic thermosetting resin is a polymer of a monomer containing at least one compound selected from the group consisting of 2-isopropenyl-2-oxazoline, 2-(penta-4-ynyl)-2-oxazoline, 2-isocyanatoethyl acrylate, and 2-isocyanatoethyl methacrylate.

9. The electrostatic latent image developing toner according to claim 8, wherein the hydrophilic thermosetting resin is at least a resin selected from the group consisting of polyoxazoline resins, polycarbodiimide resins, and polyisocyanate resins.

10. The electrostatic latent image developing toner according to claim 8, wherein an amount of the hydrophilic thermosetting resin is at least 0.1 parts by mass and no greater than 5 parts by mass relative to 100 parts by mass of the toner cores, and an amount of the hydrophobic thermoplastic resin is at least 30 parts by mass and no greater than 150 parts by mass relative 100 parts by mass of the toner cores.

11. The electrostatic latent image developing toner according to claim 8, wherein the toner core contains a polyester resin.

12. The electrostatic latent image developing toner according to claim 8, wherein the toner core contains a polyester resin, the hydrophilic thermosetting resin is a carbodiimide group-containing polymer, and the hydrophobic thermoplastic resin is a styrene-acrylic acid-based copolymer.

13. The electrostatic latent image developing toner according to claim 8, wherein the toner core contains a polyester resin, the hydrophilic thermosetting resin is a isocyanate group-containing polymer, and the hydrophobic thermoplastic resin is a styrene-acrylic acid-based copolymer.

14. The electrostatic latent image developing toner according to claim 8, wherein the toner core contains a polyester resin, the hydrophilic thermosetting resin is an oxazoline group-containing polymer, and the hydrophobic thermoplastic resin is a styrene-acrylic acid-based copolymer.

* * * * *